United States Patent [19]

Pfister et al.

[11] Patent Number: 4,469,287

[45] Date of Patent: Sep. 4, 1984

[54] CASH REGISTER TAPE VIEWER

[75] Inventors: Clifford O. Pfister, Madison, Wis.; Alan L. Strand, Glenview; Robert W. Cormack, Downers Grove, both of Ill.

[73] Assignee: Psychological Systems Corp., Oak Brook, Ill.

[21] Appl. No.: 418,728

[22] Filed: Sep. 16, 1982

[51] Int. Cl.[3] ..... B41J 15/02; B21C 47/22

[52] U.S. Cl. ..... 242/67.3 R; 40/347; 40/518

[58] Field of Search ..... 242/55, 67.1 R, 67.3 R, 242/67.1 D, 76, 96, 68.7; 40/343, 347, 471, 518; 434/182

[56] References Cited

U.S. PATENT DOCUMENTS

| | | | |
|---|---|---|---|
| 585,501 | 6/1897 | Benscoter | 40/347 |
| 3,033,481 | 5/1962 | Wolk | 242/67.1 R |
| 3,113,742 | 12/1963 | Bevan et al. | 242/67.1 R |
| 3,955,772 | 5/1976 | Chisholm et al. | 242/68.7 |
| 4,168,038 | 9/1979 | Nims | 242/67.3 R |

FOREIGN PATENT DOCUMENTS

| | | | |
|---|---|---|---|
| 822610 | 1/1938 | France | 40/518 |
| 151551 | 9/1982 | Japan | 242/67.1 R |
| 2042235 | 9/1980 | United Kingdom | 40/518 |

*Primary Examiner*—Stuart S. Levy
*Assistant Examiner*—Lloyd D. Doigan
*Attorney, Agent, or Firm*—Edmond T. Patnaude

[57] ABSTRACT

An upright support plate carries a fixed shaft which rotatably receives a cash register tape roll and a rotatable take-up shaft to which the outer end of the cash register tape may be removably attached with the tape extending across a tape support table which is pivotably mounted to the support plate. A tape guide and bearing plate is located parallel to the support plate and is adjustable relative thereto with the cash register tape roll and the take-up shaft located between the two plates.

11 Claims, 3 Drawing Figures

CASH REGISTER TAPE VIEWER

SPECIFICATION

The present invention relates in general to devices for winding a length of tape from one roll to another, and it relates in particular to a device for use in reviewing the data and other information printed on a cash register tape.

BACKGROUND OF THE INVENTION

It is common practice in retail stores, restaurants and the like to review cash register tapes in order to monitor the transactions recorded on such tapes. This has usually been done by observing the tape as it is manually unwound from the used roll. The unwound tape has been collected in a box or other suitable container or it may have been allowed to fall to the floor and subsequently discarded.

There is a need for a relatively inexpensive device which will facilitate making a review of cash register tapes and which will retain the reviewed tape in a suitable condition for storage.

SUMMARY OF THE INVENTION

Briefly, there is provided in accordance with the present invention a relatively simple and inexpensive scanning device which may be used to transport the cash register tape across a viewing table while unwinding it from one roll and winding it onto another. The device will accommodate cash register tapes of different widths and the tapes may be quickly and easily placed in the device and after being reviewed removed therefrom.

In a preferred embodiment of the invention, the scanning device includes a base plate carrying an upright support plate to which a cash register tape roll is adapted to be rotatably mounted, a rotatable take-up shaft, and a viewing table pivotably attached to the support plate and across which the tape is transported as it is wound onto the take-up shaft. A tape guide and bearing plate is slidably mounted on the base plate and comprises an upright plate which provides one edge guide for the tape as it is wound onto the take-up shaft and further provides a bearing surface for the distal end of the take-up shaft..

GENERAL DESCRIPTION OF THE DRAWING

The present invention will be better understood by a reading of the following detailed description taken in connection with the accompanying drawing wherein.

DETAILED DESCRIPTION OF A PREFERRED EMBODIMENT OF THE INVENTION

Figure 1:
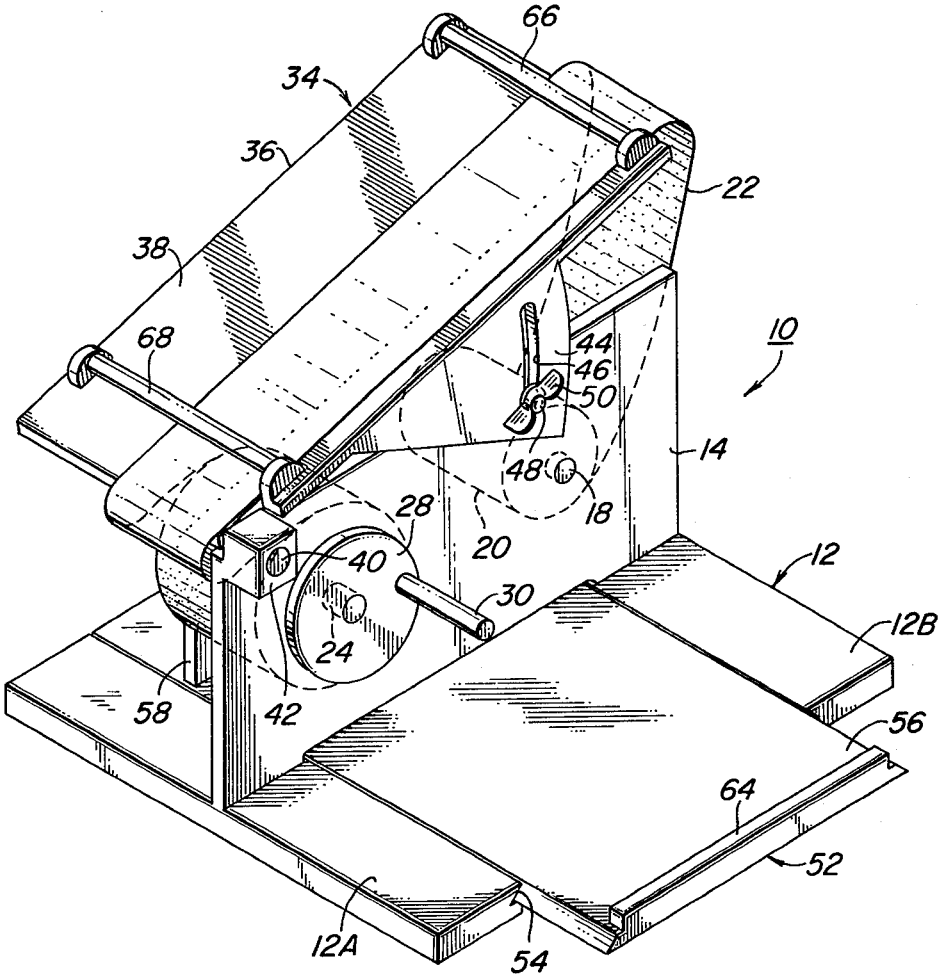
FIG. 1 is a perspective view of a cash register tape scanner embodying the present invention.

A cash register tape scanner embodying the present invention is generally indicated by the reference character 10 and may be seen to include a rectangular base plate 12 formed of parts 12A and 12B to which is fixedly mounted an upright support plate 14. The support plate 14 may be integral with the base plate 12 as shown, or it may be a separate part which is fixedly attached to the base member in any suitable manner. Four foot pads 16 are afixed to the bottom surface of the base plate 12 near the respective corners thereof. The pads 16 may be pieces of felt or the like which prevent marring of the surface on which the scanner 10 is supported. Extending from the rear side of the support plate 14, as viewed in FIG. 1, is a fixed rod or shaft 18 which is adapted rotatably to receive a roll 20 of used cash register tape 22. A take-up shaft 24 extends through a cylindrical bearing hole 26 in the support plate 14, and a disc 28 is fixed to one end portion of the take-up shaft 24. A handle 30 is fixed to the disc 28 and is used to manually rotate the disc and the attached take-up shaft 24 in the opening 26 in the upright support plate 14 The take-up shaft 24 is provided with a diametrically extending longitudinal slot 32 for receiving the end of the tape which is to be rolled onto the takeup shaft 24. The take-up shaft 24 is tapered and converges toward the distal end so as to facilitate removal of the tape after it has been wound onto the take-up shaft 24.

A viewing table 34 comprises a plate member 36 having a flat upper surface 38 across which the tape 22 is transported as it is unwound from the roll 20 and wound onto the take-up shaft 24. As shown, the plate member 36 is pivotably mcunted to the upright support plate 14 by means of a shaft 40 extending laterally from the front end of the plate 36 through a journal block 42 which may be integral with the upright support plate 14 or which may be fixedly mounted thereto. An arcuate member 44 depends from one side of the plate 36 along one side the upright support plate 14 and is provided with an arcuate slot 46 which receives a threaded shank portion of a bolt 48. A thumb nut 50 is threaded onto the bolt 48 against the outer face of the member 44 to frictionally lock the table 34 in the pivotably adjusted position.

Figure 2:
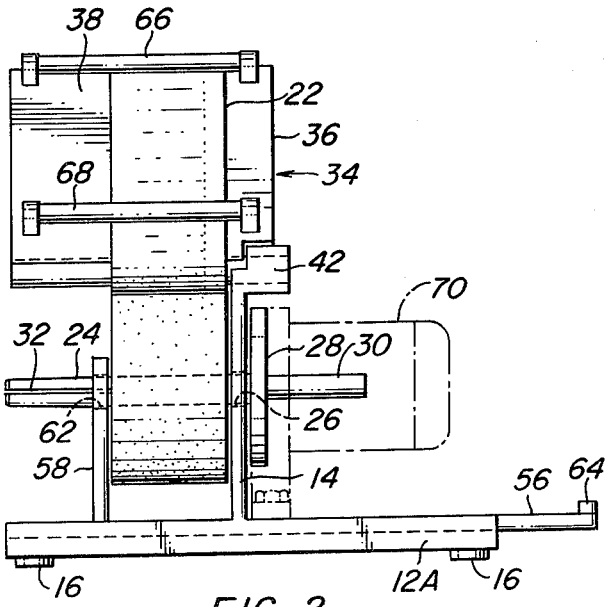
FIG. 2 is a front view of the scanner of FIG. 1.
Figure 3:
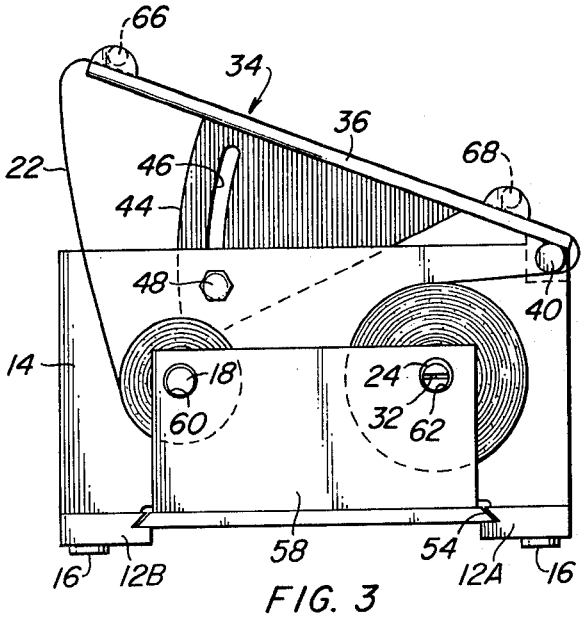
FIG. 3 is an elevational view taken from the left-hand side of the scanner as viewed in FIG. 2.

A tape edge guide member 52 is slidably mounted in a dove-tail groove 54 in the base member 12 and includes a flat planar part 46 which is slidably movably under the support plate 14. An upright guide plate 58 is affixed to the rear edge of the part 56 as viewed in FIG. 1. The guide plate 58 includes first and second cylindrical holes 60 and 62 which respectively receive the ends of the shafts 18 and 24. The plate 58 itself is adapted to be adjustably positioned in proximity to the outer edge of the cash register tape so as to guide it into a neat roll as it is wound onto the take-up shaft 24. An upright stop member 64 is provided at the opposite end of the base plate 56 to prevent complete disassembly of the guide member 52 from the remainder of the device. The member 56 is sufficiently long, however, so that when it is moved fully to the rear as viewed in FIG. 2 with the stop 64 engaging the upright plate 14, there is sufficient space between the guide plate 58 and the end of the fixed shaft 18 to permit placement of a cash register tape roll thereon.

When using the scanner device 10, the guide member 52 is first moved to the left as viewed from the front, and the roll of cash register tape to be scanned is placed on the fixed shaft 18. The end of the tape 22 is then threaded under a pair of guide bars 66 and 68 spaced a short distance above the surface 38 near the rear and front of the viewing table 34. The free end of the tape is then inserted into the slot 32 in the take-up shaft with one edge of the tape in proximity to the upright support plate 14. The guide member is then moved to the right and the ends of the shafts 18 and 24 positioned in the respective openings 60 and 62. There is sufficient friction between the plate 56 of the guide member and the dove-tailed slot 54 to hold the guide member in the adjusted position. The thumb nut 50 is then loosened and the table pivoted to the desired angle for optimum viewing of the tape. The nut 50 is then tightened to hold the viewing table in the adjusted position. The handle may then be used to rotate the disc 28 thereby to rotate the take-up shaft 24 and wind the tape thereon. As the tape is wound onto the take-up shaft 24 and thus unwound from the used roll 20, it is transported across the surface 38 of the viewing table. The surface 38 also provides a writing surface to permit writing of notes or other information on the tape during the scanning and monitoring operation.

After the tape 22 has been fully or partially wound onto the take-up shaft 24, the roll of scanned tape may be readily removed from the shaft 24 simply by pulling the disc 28 and the shaft 24 out through the opening 26 in the plate 14. Inasmuch as the shaft 24 is tapered the wound tape does not bind on the take-up shaft so that the shaft is very easily removed. The roll of scanned tape is thus held between the guide plate 58 and the support plate 14 until it is manually removed. Accordingly, inadvertent unravelling of the roll does not occur.

The scanner device 10 as shown in FIG. 1 is manually operated. However, if desired an electric motor as shown in phantom at 70 in FIG. 2 may be mounted to the disc 28 to provide a motor drive for the take-up shaft 24.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. Apparatus for use in auditing a cash register tape, comprising in combination a base, an upright support structure mounted to said base, a first spindle mounted to said support structure and having one free end, said first spindle being adapted to receive a roll of cash register tape to be viewed, a second spindle rotatably mounted to said support structure and having one free end, said second spindle having means thereon for attachably receiving the end of a roll of cash register tape mounted on said first spindle, means for rotating said second spindle to transfer tape from a roll of cash register tape mounted on said first spindle to said second spindle, and guide means including an upright guide plate fixedly mounted to a guide bottom member, said guide bottom member being slidably mounted to said base with said upright guide plate extending perpendicularly to the principal longitudinal axes of said spindles, said upright guide plate having an opening for receiving said second spindle, and said guide bottom member slidable movement being in a direction parallel to said axes for adjustable disposition of said upright guide plate in proximity to one edge of a cash register tape mounted to said spindles.

2. Apparatus according to claim 1 wherein said upright support structure comprises a single upright support plate fixedly mounted to said base, and said upright guide plate and said fixed upright support plate are adapted to be located in proximity to the opposite edges of a cash register tape mounted to said spindles.

3. Apparatus according to claim 2 wherein said base comprises a flat plate having a groove in the upper face, said bottom member of said guide means being located in said groove providing for the slidable movement of said guide bottom member.

4. Apparatus according to claim 1, further comprising a member mounted by said support structure above said spindels and having a writing surface across which said tape is adapted to extend.

5. Apparatus according to claim 4, comprising first and second tape guides disposed at opposite ends of said writing surface and through which said tape is adapted to extend.

6. Apparatus according to claim 5 comprising means mounting said member to said support structure for adjustable pivotal movement about an axis extending parallel to said spindels.

7. Apparatus according to claim 6 comprising means for locking said member in a fixed position relative to said support structure.

8. Apparatus according to claim 1 wherein said means for rotating comprises an electric motor.

9. Apparatus according to claim 1 wherein said second spindle is slidably removable through said support structure from the side opposite said guide plate.

10. Apparatus according to claim 1 wherein said second spindle is convergent toward the free end thereof.

11. Apparatus for use in auditing a cash register tape, comprising in combination a base plate having a groove in its upper surface, an upright support member fixedly mounted to said base plate, a first spindle mounted to said upright support member and having one free end, said first spindle being adapted to receive a roll of cash register tape to be viewed, a second spindle rotatably mounted to said upright support member and having one free end, said second spindle having means thereon for attachably receiving the end of a roll of cash register tape mounted on said first spindle, said upright support member located in proximity to one edge of said cash register tape, means for rotating said second spindle to transfer tape from the roll of cash register tape mounted on said first spindle to said second spindle, a guide bottom member slidably received in said groove in said base plate, an upright guide plate fixedly mounted to said guide bottom member extending perpendicularly to the principal longitudinal axes of said spindles, said guide plate having an opening for receiving said second spindle, and said guide bottom member slidable movement being in a direction parallel to said axes providing adjustable disposition of said guide plate in proximity to the opposite edge of said cash register tape mounted to said spindles.

* * * * *